US005211598A

United States Patent [19]

Hall

[11] Patent Number: 5,211,598

[45] Date of Patent: May 18, 1993

[54] EXERCISE BRASSIERE

[76] Inventor: Desiree L. Hall, 2880 Mustang, Las Vegas, Nev. 89108

[21] Appl. No.: 641,262

[22] Filed: Jan. 15, 1991

[51] Int. Cl.[5] ..... A41C 3/00

[52] U.S. Cl. ..... 450/1; 450/60; 450/65; 450/66; 450/70; 450/74; 450/75; 2/73

[58] Field of Search ..... 450/60, 61, 65, 66, 450/67, 70, 74, 75, 1; 2/67, 73, 109, 110

[56] References Cited

U.S. PATENT DOCUMENTS

| | | | |
|---|---|---|---|
| 1,095,681 | 5/1914 | Smith | 450/66 |
| 2,400,499 | 5/1946 | Gerace | 450/60 X |
| 2,881,765 | 4/1959 | Sloate | 450/61 X |
| 3,136,317 | 6/1964 | Freedman | 450/60 X |
| 3,144,869 | 8/1964 | Blair | 450/74 |
| 3,422,818 | 1/1969 | Erteszek | 450/60 X |
| 3,630,208 | 12/1971 | Werth . | |
| 4,289,137 | 9/1981 | Dell et al. . | |
| 4,538,614 | 9/1985 | Henderson | 450/70 |
| 4,538,614 | 9/1985 | Henderson . | |
| 4,583,544 | 4/1986 | Flanagan et al. . | |
| 4,816,005 | 3/1989 | Braaten | 450/66 X |
| 4,853,976 | 8/1989 | Mertz | 2/67 |
| 4,875,236 | 10/1989 | Boynton | 2/67 |
| 4,909,771 | 3/1990 | Bergman | 450/66 X |
| 4,956,878 | 9/1990 | Boynton | 2/67 |
| 4,957,466 | 9/1990 | Hopps | 430/65 X |
| 5,033,986 | 7/1991 | Fergenbaum et al. | 2/67 |

FOREIGN PATENT DOCUMENTS

| | | | |
|---|---|---|---|
| 2607613 | 1/1977 | Fed. Rep. of Germany | 2/67 |
| 2935780 | 4/1981 | Fed. Rep. of Germany | 2/67 |
| 1075244 | 10/1954 | France | 2/67 |
| 1576736 | 8/1969 | France | 450/60 |

*Primary Examiner*—Clifford D. Crowder
*Assistant Examiner*—Jeanette E. Chapman
*Attorney, Agent, or Firm*—Poms, Smith, Lande & Rose

[57] ABSTRACT

An exercise brassiere having an outer layer adapted to fit over the wearer's upper torso and shoulders and a coextensive inner layer adapted to fit over the front portion of the wearer's upper torso and shoulders. The inner layer and the outer layer are constructed of a lightweight, flexible two-way stretch fabric having a stretchability significantly greater in the horizontal direction than in the vertical direction to provide adequate and comfortable support to the wearer's breasts. The inner layer has cut into it a pair of apertures sized and positioned to receive the breasts of the wearer the apertures being covered by the outer layer. The apertures also provide support to the wearer's breasts and further provide for a natural, contoured appearance to the wearer's breasts. A smooth, lightweight, flexible fabric middle layer may be included between the inner layer and the outer layer so that it covers the apertures in the inner layer and also contacts the skin of the wearer's breasts thereby preventing rashes and/or chafing.

16 Claims, 1 Drawing Sheet

EXERCISE BRASSIERE

BACKGROUND OF THE INVENTION

This invention relates generally to brassieres and, more particularly, to exercise brassieres that provide adequate and comfortable support and that provide for a more natural, contoured appearance rather than a flattened appearance.

With exercise and athletics now a large part of the daily activities of many women, there is a wide variety of exercise clothing from which a woman may choose to wear. In choosing an exercise brassiere, a woman ideally will choose a brassiere that not only looks good on her, but also that provides adequate and comfortable support. Support is important, not only for comfort, but also for health reasons, since without support, the breast tissue may deteriorate and the breasts may prematurely sag. An ideal exercise brassiere will provide support similar to the support that an underwire brassiere provides, but without the bulky, uncomfortable underwire.

Although many types of exercise brassieres have been developed over the years, none are believed to have provided the desired degree of comfort and support. For instance, seams or buckles in the fabric of many prior brassieres can chafe and/or irritate the skin of the wearer. Some exercise brassieres have been made of a fabric that does not allow the skin to breathe, and thus the skin of the wearer may not be allowed to adequately cool during exercise. Furthermore, some of the brassiere fabrics that contact the wearer's skin cannot absorb the perspiration that can accumulate during exercise, thus causing the skin to develop a rash.

Additionally, some exercise brassieres have not provided adequate support. Some exercise brassieres consist of only a lightweight fabric, of varying degrees of elasticity, that covers the breasts of the wearer. Thus, wearers of these types of exercise brassieres may suffer from soreness in the muscles supporting the breasts and may incur some of the health risks outlined above.

Furthermore, some exercise brassieres have not provided for a natural, contoured appearance of the breasts. These brassieres have a continuous front panel that binds the breasts to the body, providing an undesired, flattened appearance.

It will be appreciated from the foregoing that there is a definite need for an exercise brassiere that provides adequate support for the breasts, that is also comfortable to wear, and that provides a more natural, contoured appearance rather than a flattened appearance. The present invention fulfills these needs.

SUMMARY OF THE INVENTION

The present invention resides in an exercise brassiere providing adequate and comfortable support of the wearer's breasts, and providing for a natural, contoured appearance of the breasts. More particularly, the exercise brassiere of the present invention includes an outer layer adapted to fit over the wearer's upper torso and shoulders and an inner layer adapted to fit over the front portion of the wearer's upper torso and shoulders. Both the inner layer and the outer layer are constructed of a lightweight, flexible, two-way stretch fabric having a knit pattern having a stretchability significantly greater in the horizontal direction than in the vertical direction. The fabric of the inner layer has cut into it two circular apertures sized and positioned to receive the breasts of the wearer. The outer layer is connected to the inner layer at their top edges, bottom edges, and side edges, and it thus covers the apertures of the inner layer.

In one aspect of the invention, the outer layer of the exercise brassiere is constructed of a continuous front panel and a continuous rear panel, each having two side edges and two shoulder straps. The outer layer is formed by connecting the front panel together to the rear panel at their side edges and at their shoulder straps.

In another aspect of the invention, a middle layer may be added between the inner layer and outer layer. The middle layer, which is constructed of a smooth, lightweight, flexible fabric having a stretchability significantly greater in the horizontal direction than in the vertical direction, is connected to the inner layer. The middle layer covers the apertures in the front panel and contacts the skin of the wearer's breasts to provide extra comfort and moisture-absorbency and thereby prevent chafing and rashes.

In yet another aspect of the invention, a covering layer constructed of a lightweight flexible fabric having a stretchability significantly greater in the horizontal direction than in the vertical direction is coextensive with the outer layer. The covering layer is constructed of a front panel and a rear panel, each having two side edges and two shoulder straps. The covering layer is formed by connecting the front panel together to the rear panel at their side edges and at their shoulder straps. The covering layer preferably is constructed of a decorative fabric, suitable to the taste of the wearer, so that the exercise brassiere may be worn alone as a top.

The inner layer, middle layer, outer layer, and covering layer each have a bottom edge, a top edge, and side edges. The bottom edges, top edges and side edges of the inner layer, middle layer, outer layer, and covering layer are aligned and then connected together to form a torso opening, neck opening, and two arm openings, respectively. Attached to each of these connections is an elastic band extending continuously around each of the openings. A separate fabric layer covers the elastic band of the torso opening. The fabric that forms the covering layer covers the elastic bands of the neck and arm openings.

Other aspects and advantages of the present invention will become apparent from the following description of the preferred embodiment, taken in conjunction with the accompanying drawings, which illustrate, by way of example, the principles of the invention.

DESCRIPTION OF THE PREFERRED EMBODIMENT

As shown in the exemplary drawings, the present invention is embodied in an exercise brassiere 10 having an outer layer 12 adapted to fit over a wearer's upper torso and shoulders and an inner layer 14 adapted to fit over the front portion of the wearer's upper torso and shoulders. In accordance with the invention, a pair of apertures 16 and 18 sized and positioned to receive the wearer's breasts are formed in the fabric of the inner layer. The apertures provide an underwire-type of support to the breasts of the wearer, without the discomfort of a underwire, and also prevent the brassiere from flattening the breasts against the wearer's chest, thus providing for a more natural, contoured appearance.

Figure 4:
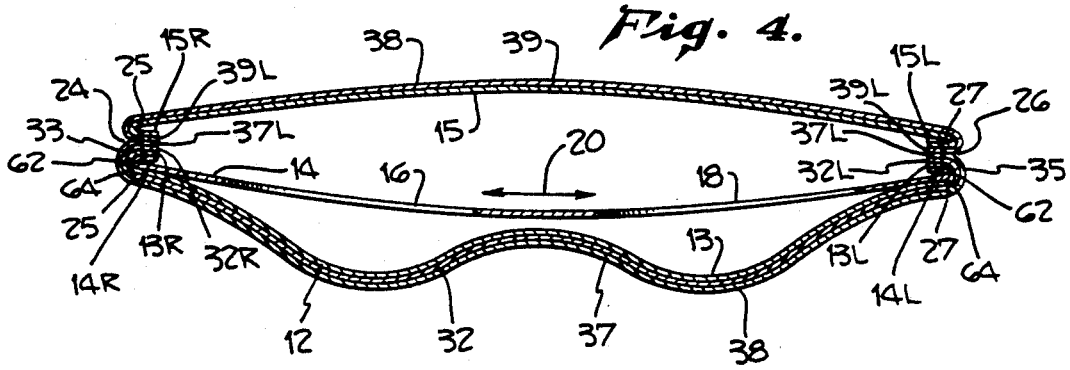
FIG. 4 is a sectional view of the exercise brassiere, taken substantially along the line 4—4 in FIG. 1.

The outer layer 12 and inner layer 14 both are constructed of a lightweight, flexible, two-way stretch fabric having a knit pattern having a stretchability significantly greater in the horizontal direction than in the vertical direction, as shown by the arrow 20 in FIG. 4. This type of stretchability, coupled with the positioning of the outer layer over the wearer's torso and shoulders provides the exercise brassiere with the underwire-type of support to the wearer's breasts.

The inner layer 14 has side edges 14L and 14R, a top edge 14T, a bottom edge 14B, and shoulder straps 14X and 14Y. A seam is stitched around the circumference of each of the two apertures 16 and 18 in the inner layer to prevent unraveling of the fabric, the seam being of a soft thread such as cotton so that the seam does not irritate the skin of the wearer's breasts.

The outer layer 12 may be formed from a continuous front panel 13 and a continuous rear panel 15. The front panel has side edges 13L and 13R, a top edge 13T, a bottom edge 13B, and shoulder straps 13X and 13Y and the rear panel has side edges 15L and 15R, a top edge 15T, a bottom edge 15B, and shoulder straps 15X and 15Y. The front panel and the rear panel are connected together at their respective side edges by seams 24 and 26 and at their respective shoulder straps by seams 28 and 30, to form the outer layer.

A middle layer 32 constructed of a flexible, lightweight fabric may be included between the inner layer 14 and outer layer 12. The fabric of the middle layer has a stretchability significantly greater in the horizontal direction than in the vertical direction. The middle layer has side edges 32L and 32R, a top edge 32T, a bottom edge 32B, and shoulder straps 32X and 32Y. When aligned with and connected to the inner layer, the middle panel covers the inner layer's apertures 16 and 18 and contacts the skin of the wearer's breasts to provide extra comfort and moisture-absorbency and thereby prevent rashes and chafing, since the fabric of the middle layer is smooth and moisture-absorbent.

A covering layer 38 constructed of a flexible, lightweight fabric having a stretchability significantly greater in the horizontal direction than in the vertical direction may be included to cover the outer layer 12. Preferably constructed of a decorative fabric, suitable to the taste of the wearer, the covering layer provides an exposed layer so that the exercise brassiere can be worn alone as a top.

The covering layer may be formed from a front panel 37 and a rear panel 39, with the front panel having side edges 37L and 37R, a top edge 37T, a bottom edge 37B, and shoulder straps 37X and 37Y and with the rear panel having side edges 39L and 39R, a top edge 39T, a bottom edge 39B, and shoulder straps 39X and 39Y. The front panel and the rear panel are connected together at their respective side edges by seams 25 and 27 and at their respective shoulder straps by seams 29 and 31 to form the covering layer.

The exercise brassiere is formed by connecting together the inner layer 14 to the middle layer 32 to the outer layer 12 to the covering layer 38. Each layer is aligned at their top edges, bottom edges, side edges, and shoulder strap edges and are connected together by seams at these places. The following description provides more detail as to how the brassiere is formed from the four layers.

Figure 1:
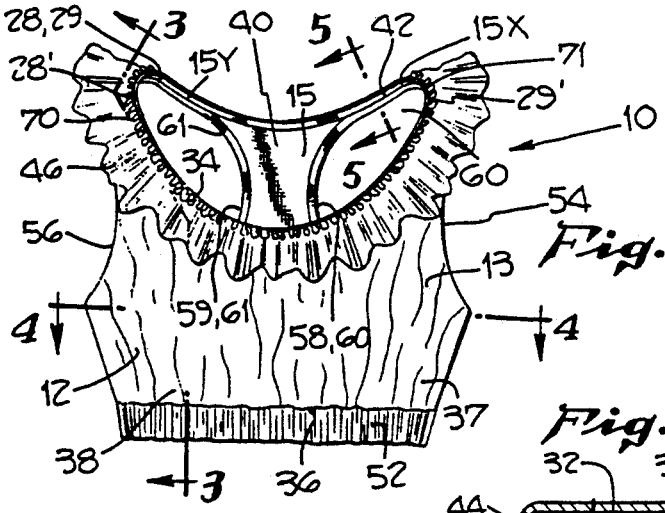
FIG. 1 is a front view of an exercise brassiere embodying the present invention.
Figure 2:
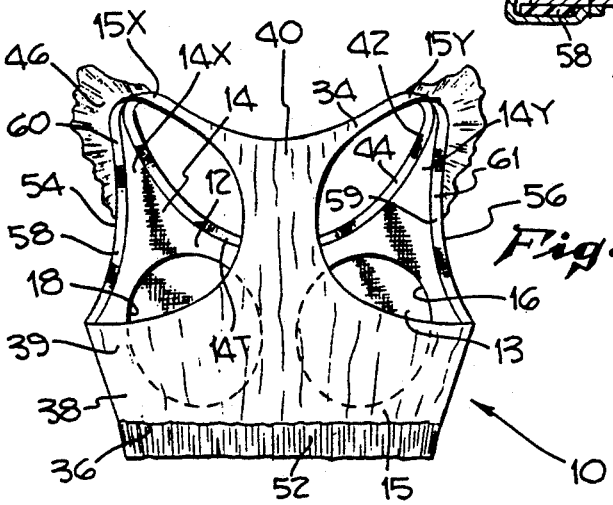
FIG. 2 is a rear view of the exercise brassiere of FIG. 1.
Figure 6:
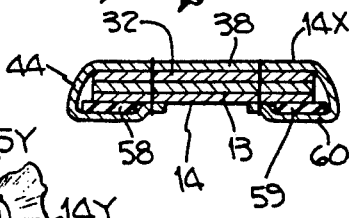
FIG. 6 is a sectional view of the exercise brassiere, taken substantially along the line 6—6 in FIG. 1.
Figure 5:
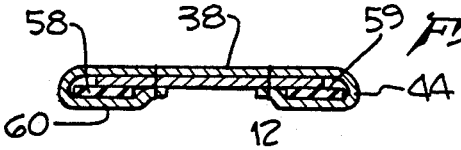
FIG. 5 is a sectional view of the exercise brassiere, taken substantially along the line 5—5 in FIG. 1.

The top edges of each layer, 14T, 32T, 13T, 15T, 37T, and 39T are aligned and then connected together by the seam 34, thus forming a neck opening 40. Also attached at this seam is an elastic band 42, extending continuously around the neck opening. (FIGS. 5 and 6). The elastic band is covered by a fabric strip 44, an extension of the fabric that forms the covering layer 38. A decorative fabric ruffle 46 also may be attached at the seam 34, extending around the front and sides of the neck opening.

Figure 3:
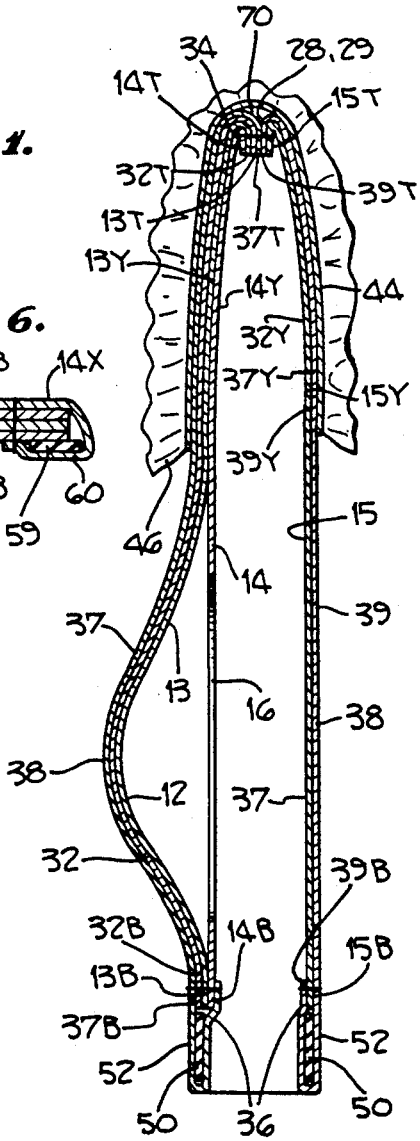
FIG. 3 is a sectional view of the exercise brassiere, taken substantially along the line 3—3 in FIG. 1.

Similarly, the bottom edges of each layer, 14B, 32B, 13B, 15B, 37B, and 39B are aligned and then connected together by the seam 36, thus forming torso opening 48. Also attached at the seam 36 is an elastic band 50, extending continuously around the torso opening. (FIG. 3). The elastic band is covered by fabric strip 52 also connected at seam 36.

Additionally, the inner layer 14 and the middle layer 32 are connected by the seam 62 at their side edges, 14L, and 32L, and by the seam 64 at their side edges, 14R and 32R, respectively, and these seams are further aligned with the seams 24 and 26 of the outer layer 12 and the seams 25 and 27 of the covering layer, respectively. These four seams are then connected together by seams 33 and 35, thus forming a pair of arm openings 54 and 56. It should be clear that side edges 12L, 13L, 32L, 34L, and 39L may be connected together by the single seam 24' and that side edges 12R, 13R, 15R, 15R, 32R, 37R, and 39R may also be connected together by the single seam 26'. Also attached at these seams are elastic bands 58 and 59, extending continuously around each of the arm openings. (FIGS. 5 and 6) The elastic band is covered by the fabric strips 60 and 61, which are extensions of the fabric that forms the covering layer 38.

Similarly, the inner layer 14 and middle layer 12 are connected at their shoulder straps 14X and 32X by the seam 66 and at their shoulder straps 14Y and 32Y by the seam 68 and these seams are further aligned with the seams 28 and 30 of the outer layer and the seams 29 and 31 of the covering layer respectively. These seams are then connected together by the seam 70 and 71, respectively. It should be clear that shoulder straps 14X, 32X, 13X, 15X, and 39X may be connected together by the single seam 28' and that shoulder straps 14Y, 32Y, 15Y, 37Y and 39Y may also be connected together by the single seam 29'.

From the foregoing, it will be appreciated that the exercise brassiere of the invention provides an adequate and comfortable underwire-type of support to the wearer's breasts by the use of an outer layer 12 adapted to fit over the wearer's upper torso and shoulders connected to, and covering, an inner layer 14 adapted to fit over the front portion of the wearer's upper torso and shoulders, the inner layer having a pair of apertures 16 and 18 sized and positioned to receive the wearer's breasts, and both the inner layer and the outer layer being constructed of a fabric having a knit pattern having a stretchability significantly greater in the horizontal direction than in the vertical direction.

Although the invention has been described in detail with reference to its presently preferred embodiment, it will be understood by one of ordinary skill in the art that various modifications can be made without departing from the spirit and scope of the invention. Accordingly, the invention is defined only by the following claims.

I claim:

1. An exercise brassiere adapted to fit over the upper torso, breasts and shoulders from a front portion to a back portion of a wearer, the breasts and shoulders of the wearer defining a horizontal and vertical direction and having a front portion and a back portion, the exercise brassiere comprising:

an outer layer constructed of a lightweight, flexible, two-way stretch fabric, having a front portion adapted to fit over the wearer's breasts and over the front portion of the wearer's shoulders and a back portion adapted to fit over the back portion of the wearer's upper torso at the level of the breasts and over the back portion of the wearer's shoulders, the flexible fabric of the outer layer having a stretchability significantly greater in the horizontal direction than in the vertical direction;

an inner layer constructed of a lightweight, flexible, two-way stretch fabric and adapted to fit over the front portion of the wearer's upper torso and shoulders, the inner layer having two circular apertures sized and positioned to receive the breasts of the wearer, the flexible fabric of the inner layer having a stretchability significantly greater in the horizontal direction than in the vertical direction; and a middle layer constructed of a lightweight, flexible, smooth, moisture-absorbent fabric and adapted to fit over the front portion of the wearer's upper torso and shoulders and also adapted to coextend with substantially all the inner layer and to cover the apertures in the inner layer, the flexible fabric of the middle layer having a stretchability significantly greater in the horizontal direction than in the vertical direction, the front portion of the outer layer being coextensive with substantially all of the inner layer and middle layer and wherein the middle layer covers the apertures of the inner layer.

2. An exercise brassiere as defined in claim 1, wherein the outer layer includes:

a continuous front panel having two side edges and a plurality of shoulder straps; and a continuous rear panel having two side edges and a plurality of shoulder straps, the front and rear panels being connected together at their side edges and plurality of shoulder straps.

3. An exercise brassiere as defined in claim 1, further including a covering layer constructed of a lightweight, flexible fabric and adapted to fit over the wearer's upper torso and shoulders and also adapted to coextend with and cover substantially all of the outer layer, the flexible fabric of the covering layer having a stretchability significantly greater in the horizontal direction than in the vertical direction.

4. An exercise brassiere as defined in claim 3, wherein the covering layer includes:

a front panel with two side edges and a plurality of shoulder straps; and a rear panel with two side edges and a plurality of shoulder straps, the front and rear panels being connected together at their side edges and plurality of shoulder straps.

5. An exercise brassiere adapted to fit over the upper torso, breasts and shoulders from a front portion to a back portion of a wearer, the breasts and shoulders of the wearer defining a horizontal and vertical direction and having a front portion and a back portion, the exercise brassiere comprising:

an outer layer constructed of a lightweight, flexible, two way stretch fabric and having a front portion adapted to fit over the wearer's breasts and over the front portion of the wearer's shoulders and a back portion adapted to fit over the back portion of the wearer's upper torso at the level of the breasts and over the back portion of the wearer's shoulders, the flexible fabric of the outer layer having a stretchability significantly greater in the horizontal direction than in the vertical direction;

an inner layer constructed of a lightweight, flexible, two way stretch fabric and adapted to fit over the front portion of the wearer's upper torso and shoulders, the inner layer having two circular apertures sized and positioned to receive the breasts of the wearer, the flexible fabric of the inner layer having a stretchability significantly greater in the horizontal direction than in the vertical direction, the front portion of the outer layer being coextensive with substantially all of the inner layer and wherein the outer layer covers the apertures of the inner layer;

a middle layer constructed of a lightweight, flexible fabric and adapted to fit over the front portion of the wearer's upper torso and shoulders, the flexible fabric of the middle layer having a stretchability significantly greater in the horizontal direction than in the vertical direction; and a covering layer constructed of a lightweight, flexible fabric and adapted to fit over the wearer's upper torso and shoulders, the flexible fabric of the covering layer having a stretchability significantly greater in the horizontal direction than in the vertical direction, wherein the middle layer is adapted to coextend with substantially all of the inner layer and to cover the apertures of the inner layer and the covering layer is adapted to coextend with and cover substantially all of the outer layer.

6. An exercise brassiere as defined in claim 5, wherein the covering layer includes:

a front panel with two side edges and a plurality of shoulder straps; and a rear panel with two side edges and a plurality of shoulder straps, the front and rear panels being connected together at their side edges and plurality of shoulder straps.

7. An exercise brassiere as defined in claim 6, wherein:

the inner layer, the middle layer, the outer layer, and the covering layer have coextensive bottom edges;

the exercise brassiere further includes an elastic band attached to the coextensive bottom edges of the inner layer, the middle layer, the outer layer and the covering layer, the elastic band extending continuously around the brassiere; and a fabric strip located around the elastic band.

8. An exercise brassiere as defined in claim 6, wherein:

the inner layer, the middle layer, the outer layer, and the covering layer have coextensive side edges forming two arm openings;

the exercise brassiere further includes a continuous elastic band surrounding each arm opening; and a fabric strip extending from the covering layer and located around the elastic band.

9. An exercise brassiere as defined in claim 6, wherein:

the inner layer, the middle layer, the outer layer, and the covering layer have coextensive top edges forming a neck opening;

the exercise brassiere further includes a continuous elastic band surrounding the neck opening; and a fabric strip extending from the covering layer and located around the elastic band.

10. An exercise brassiere adapted to fit over the upper torso and shoulders of a wearer, the upper torso and shoulders of the wearer defining a horizontal and vertical direction and having a front portion and a back portion, the exercise brassiere comprising:

an outer layer constructed of a lightweight, flexible, two-way stretch fabric having a front portion adapted to fit over the wearer's breasts and over the front portion of the wearer's shoulders and a back portion adapted to fit over the back portion of the wearer's upper torso at the level of the breasts and over the back portion of the wearer's shoulders and having a stretchability significantly greater in the horizontal direction than in the vertical direction, including a continuous front panel with two side edges, a top edge, a bottom edge, and a plurality of shoulder straps; and a continuous rear panel with two side edges, a top edge, a bottom edge, and a plurality of shoulder straps, the front and the rear panels being connected together at their side edges and plurality of shoulder straps;

an inner layer constructed of a lightweight, flexible, two-way stretch fabric and adapted to fit over the front portion of the wearer's upper torso and shoulders and having a stretchability significantly greater in the horizontal direction than in the vertical direction, with two circular apertures sized and positioned to receive the wearer's breasts and with two side edges, a top edge, a bottom edge, and a plurality of shoulder straps; and a middle layer constructed of a lightweight, flexible, smooth, moisture-absorbent fabric and adapted to fit over the front portion of the wearer's upper torso and shoulders and to cover the apertures of the inner layer and having two side edges, a top edge, a bottom edge, and a plurality of shoulder straps, the flexible fabric of the middle layer having a stretchability significantly greater in the horizontal direction than in the vertical direction, wherein the inner layer, the middle layer, and the front panel of the outer layer are adapted to connect together at their top edges, at their bottom edges, at their side edges, and at their plurality of shoulder straps.

11. An exercise brassiere as defined in claim 10, further including a covering layer constructed of a lightweight, flexible fabric and adapted to fit over the wearer's upper torso and shoulders, the flexible fabric of the covering layer having a stretchability significantly greater in the horizontal direction than in the vertical direction, the covering layer including a front panel with two side edges, a top edge, a bottom edge, and a plurality of shoulder straps; and a rear panel with two side edges, a top edge, a bottom edge, and a plurality of shoulder straps, the front and the rear panels being connected together at their side edges and plurality of shoulder straps, wherein the inner layer, the outer layer and the covering layer are adapted to connect together at their top edges, at their bottom edges, at their side edges, and at their plurality of shoulder straps.

12. An exercise brassiere adapted to fit over the upper torso and shoulders of a wearer, the upper torso and shoulders of the wearer defining a horizontal and vertical direction and having a front portion and a back portion, the exercise brassiere comprising:

an outer layer constructed of a lightweight, flexible two way stretch fabric having a front portion adapted to fit over the wearer's breasts and over the front portion of the wearer's shoulders and a back portion adapted to fit over the back portion of the wearer's upper torso at the level of the breasts and over the back portion of the wearer's shoulders and having a stretchability significantly greater in the horizontal direction than in the vertical direction, including:

a continuous front panel with two side edges, a top edge, a bottom edge and a plurality of shoulder straps; and a continuous rear panel with two side edges, a top edge, a bottom edge, and a plurality of shoulder straps, the front and the rear panels being connected together at their side edges and plurality of shoulder straps;

an inner layer constructed of a lightweight, flexible two way stretch fabric and adapted to fit over the front portion of the wearer's upper torso and shoulders and having a stretchability significantly greater in the horizontal direction than in the vertical direction with two circular apertures sized and positioned to receive the wearer's breasts and with two side edges, a top edge, a bottom edge, and a plurality of shoulder straps;

a middle layer constructed of a lightweight, flexible fabric and adapted to fit over the front portion of the wearer's upper torso and shoulders and to cover the apertures of the inner layer and having two side edges, a top edge, a bottom edge, and a plurality of shoulder straps, the flexible fabric of the middle layer having a stretchability significantly greater in the horizontal direction than in the vertical direction; and a covering layer constructed of a lightweight, flexible fabric and adapted to fit over the wearer's upper torso and shoulders, the flexible fabric of the covering layer having a stretchability significantly greater in the horizontal direction, the covering layer including:

a front panel with two side edges, a to edge, a bottom edge, and a plurality of shoulder straps;

a rear panel with two side edges, a top edge, a bottom edge, and a plurality of shoulder straps, the front and the rear panels being connected together at their side edges and plurality of shoulder straps, the flexible fabric of the covering layer having a stretchability significantly greater in the horizontal direction than in the vertical direction, wherein the inner layer, the middle layer, the outer layer and the covering layer are adapted to connect together at their top edges, at their bottom edges, at their side edges, and t their plurality of shoulder straps.

13. An exercise brassiere as defined in claim 12, wherein:

the coextensive bottom edges of the inner layer, the middle layer, the outer layer, and the covering layer form a torso opening; and the exercise brassiere further includes a continuous elastic band extending around the torso opening; and a fabric layer located around the elastic band.

14. An exercise brassiere as defined in claim 12, wherein:

the coextensive top edges of the inner layer, the middle layer, the outer layer, and the covering layer form a neck opening; and the exercise brassiere further includes a continuous elastic band surrounding the neck opening; and a fabric strip extending from the covering layer and located around the elastic band.

15. An exercise brassiere as defined in claim 12, wherein:

the coextensive side edges of the inner layer, the middle layer, the outer layer, and the covering layer form two arm openings; and the exercise brassiere further includes a continuous elastic band surrounding each arm opening; and a fabric strip extending from the covering layer and located around the elastic band.

16. An exercise brassiere adapted to fit over the upper torso and shoulders of a wearer, the upper torso and shoulders of the wearer defining a horizontal and vertical direction and having a front portion, the exercise brassiere comprising:

an outer layer constructed of a lightweight, flexible, two-way stretch fabric and adapted to fit over the wearer's upper torso and shoulders and having a stretchability significantly greater in the horizontal direction than in the vertical direction, including a continuous front panel with two side edges, a top edge, a bottom edge, and a plurality of shoulder straps, and a continuous rear panel with two side edges, a top edge, a bottom edge, and a plurality of shoulder straps, the front and the rear panels being connected together at their side edges and plurality of shoulder straps;

an inner layer constructed of a lightweight, flexible, two-way stretch fabric and adapted to fit over the front portion of the wearer's upper torso and shoulders and having a stretchability significantly greater in the horizontal direction than in the vertical with two circular apertures sized and positioned to receive the wearer's breasts and with two side edges, a top edge, a bottom edge, and a plurality of shoulder straps;

a middle layer constructed of a lightweight, flexible fabric and adapted to fit over the front portion of the wearer's upper torso and shoulders and to cover the apertures in the inner layer and having two side edges, a top edge, a bottom edge, and a plurality of shoulder straps, the flexible fabric of the middle layer having a stretchability significantly greater in the horizontal direction than in the vertical direction; and a covering layer constructed of a lightweight, flexible fabric and adapted to fit over the upper torso and shoulders of the wearer, the flexible fabric of the covering layer having a stretchability significantly greater in the horizontal direction than in the vertical direction, the covering layer including a front panel with two side edges, a top edge, a bottom edge, and a plurality of shoulder straps; and a rear panel with two side edges, a top edge, a bottom edge, and a plurality of shoulder straps, the front and the rear panels being connected together at their side edges and plurality of shoulder straps;

wherein the inner layer, the middle layer, the outer layer and the covering layer are adapted to connect together at their top edges to form a neck opening, at their bottom edges to form a torso opening, at their side edges to form two arm openings, and at their plurality of shoulder straps, so that the front panel of the outer layer and the middle layer cover the apertures of the inner layer, the exercise brassiere further including an elastic band surrounding the neck opening;

a fabric strip covering the elastic band surrounding the neck opening;

an elastic band surrounding the torso opening;

a fabric strip extending from the covering layer located around the elastic band surrounding the torso opening;

an elastic band surrounding each arm opening; and a fabric strip extending from the covering layer located around the elastic bands surrounding the arm openings.

* * * * *